US011315404B1

(12) United States Patent
Greer

(10) Patent No.: US 11,315,404 B1
(45) Date of Patent: Apr. 26, 2022

(54) WEARABLE PROXIMITY ALERT SYSTEM

(71) Applicant: Brian A. Greer, Goodyear, AZ (US)

(72) Inventor: Brian A. Greer, Goodyear, AZ (US)

( * ) Notice: Subject to any disclaimer, the term of this patent is extended or adjusted under 35 U.S.C. 154(b) by 0 days.

(21) Appl. No.: 16/729,262

(22) Filed: Dec. 27, 2019

Related U.S. Application Data

(60) Provisional application No. 62/785,518, filed on Dec. 27, 2018.

(51) Int. Cl.
*G08B 21/02* (2006.01)

(52) U.S. Cl.
CPC ..... *G08B 21/0266* (2013.01); *G08B 21/0236* (2013.01); *G08B 21/0255* (2013.01); *G08B 21/0291* (2013.01); *G08B 21/0294* (2013.01)

(58) Field of Classification Search
None
See application file for complete search history.

(56) References Cited

U.S. PATENT DOCUMENTS 3,695,494 A * 10/1972 Bruner ..... G04B 37/1486 24/265 WS
4,100,401 A * 7/1978 Tutt ..... A61B 5/02438 368/10
4,639,144 A * 1/1987 Chau ..... G04B 37/1486 224/164
4,855,942 A * 8/1989 Bianco ..... G16H 40/63 702/160
5,050,141 A * 9/1991 Thinesen ..... G04G 9/085 368/73
5,115,223 A * 5/1992 Moody ..... G08B 21/0247 340/539.1
5,289,163 A * 2/1994 Perez ..... G08B 21/0263 340/525
5,329,501 A * 7/1994 Meister ..... G08B 5/228 368/10
5,343,446 A * 8/1994 Simmons ..... G04G 11/00 368/107
5,475,653 A * 12/1995 Yamada ..... G04B 47/00 340/7.55
5,525,967 A * 6/1996 Azizi ..... G01S 13/74 340/539.1
5,557,259 A * 9/1996 Musa ..... G08B 21/0263 340/539.1
5,605,262 A * 2/1997 Bond ..... G04B 37/1486 224/164
5,617,074 A * 4/1997 White ..... G08B 21/023 200/532
5,812,056 A * 9/1998 Law ..... G08B 21/0202 340/539.15
5,841,352 A * 11/1998 Prakash ..... G08B 21/0247 340/573.4
5,900,817 A * 5/1999 Olmassakian ..... G08B 21/0288 340/573.1
5,939,988 A * 8/1999 Neyhart ..... G08B 21/0216 340/573.4
5,995,007 A 11/1999 Borja et al.
(Continued)

*Primary Examiner* — Curtis J King
(74) *Attorney, Agent, or Firm* — Cramer Patent & Design, PLLC; Aaron R. Cramer

(57) ABSTRACT

A wearable proximity alert system includes a first wearable band configured to be secured about an appendage of a child which is programmed to alert the wearer of a second wearable band when the bands are separated from each other by a predetermined distance.

11 Claims, 3 Drawing Sheets

(56) References Cited

U.S. PATENT DOCUMENTS 6,031,460 A 2/2000 Banks
6,127,931 A * 10/2000 Mohr ..... G08B 21/0247 340/539.1
6,215,403 B1 * 4/2001 Chan ..... A61B 5/0008 340/573.1
6,388,612 B1 * 5/2002 Neher ..... G01S 5/0018 224/164
6,563,427 B2 5/2003 Bero et al.
6,690,623 B1 * 2/2004 Maano ..... G04C 17/02 368/223
6,847,295 B1 * 1/2005 Taliaferro ..... G08B 21/0211 340/539.1
6,975,234 B2 * 12/2005 Boccacci ..... G07C 9/37 340/573.4
D520,393 S 5/2006 Darby
7,271,717 B1 * 9/2007 Amos ..... G08B 21/0202 340/522
7,511,627 B2 * 3/2009 Holoyda ..... G08B 21/0202 340/573.4
D607,361 S * 1/2010 Ahlstrom ..... D10/126
7,696,887 B1 * 4/2010 Echavarria ..... G08B 21/0247 340/573.1
D626,017 S * 10/2010 Ahlstrom ..... D10/31
D693,251 S 11/2013 Anderssen et al.
9,129,503 B2 9/2015 Borlenghi
9,508,241 B2 11/2016 DePascale
9,747,770 B1 * 8/2017 Bartlett ..... G16H 40/67
9,859,937 B2 1/2018 Chien
10,249,166 B1 * 4/2019 Carter ..... G08B 6/00
10,332,375 B1 * 6/2019 Gonzalez ..... G04B 47/063
10,911,900 B1 * 2/2021 White ..... G06F 3/167
2002/0131330 A1 * 9/2002 Zion ..... G08B 25/016 368/82
2002/0190861 A1 * 12/2002 Wentworth ..... G08B 21/0263 340/568.1
2003/0026171 A1 * 2/2003 Brewer ..... G04G 17/08 368/82
2003/0034894 A1 * 2/2003 Montagnino ..... G08B 21/0263 340/573.4
2003/0103414 A1 * 6/2003 Lyon ..... H04W 12/068 368/10
2003/0151515 A1 * 8/2003 Yuzuki ..... G08B 21/0247 340/573.4
2003/0218539 A1 * 11/2003 Hight ..... G08B 21/0266 340/539.13
2004/0046658 A1 * 3/2004 Turner ..... G08B 21/0263 340/539.11
2004/0080419 A1 * 4/2004 Martin ..... G08B 21/0288 340/573.1
2004/0198382 A1 10/2004 Wong
2005/0248453 A1 * 11/2005 Fechter ..... G08B 25/006 340/539.15
2005/0280546 A1 * 12/2005 Ganley ..... G08B 13/1427 340/573.4
2006/0139166 A1 * 6/2006 Choutier ..... G08B 21/0415 340/539.12
2006/0226973 A1 * 10/2006 Catlin ..... G08B 17/10 340/539.11
2008/0001764 A1 * 1/2008 Douglas ..... G07C 9/28 340/573.1
2008/0055072 A1 * 3/2008 Holoyda ..... G08B 21/0202 340/539.13
2008/0246656 A1 * 10/2008 Ghazarian ..... G08B 21/0202 342/357.54
2009/0042534 A1 * 2/2009 Levanen ..... G08B 21/0202 455/404.2
2010/0062710 A1 * 3/2010 Graff ..... G08B 21/0288 455/41.2
2010/0302914 A1 * 12/2010 Faucher ..... A44C 5/147 368/282
2012/0306643 A1 * 12/2012 Dugan ..... A61B 5/742 340/539.12
2012/0322380 A1 * 12/2012 Nannarone ..... G08B 21/0236 455/41.2
2013/0063268 A1 * 3/2013 Golomb ..... G08B 21/0294 340/573.4
2013/0331058 A1 * 12/2013 Harvey ..... H04W 4/90 455/404.2
2014/0124389 A1 5/2014 Borlenghi
2014/0270096 A1 * 9/2014 Ashizuka ..... G08B 21/0222 379/38
2014/0378853 A1 12/2014 McKinney et al.
2015/0035672 A1 * 2/2015 Housley ..... G08B 21/0269 340/539.13
2015/0313542 A1 * 11/2015 Goldberg ..... G04G 17/04 600/384
2015/0338979 A1 * 11/2015 Rhee ..... A61B 5/681 345/174
2016/0042633 A1 * 2/2016 Lin ..... G08B 21/0263 340/686.6
2016/0057268 A1 * 2/2016 Jiang ..... H04W 4/021 455/556.1
2016/0199664 A1 * 7/2016 Hogset ..... A61N 5/062 604/20
2016/0291550 A1 * 10/2016 Chen ..... H02J 50/10
2017/0365147 A1 * 12/2017 Pence ..... G08B 21/0261
2019/0070477 A1 * 3/2019 Caldwell ..... A63B 69/3608

* cited by examiner

WEARABLE PROXIMITY ALERT SYSTEM

RELATED APPLICATIONS

The present invention is a continuation of and was first described in and claims the benefit of U.S. Provisional Application No. 62/785,518, filed Dec. 27, 2018, the entire disclosures of which are incorporated herein by reference.

FIELD OF THE INVENTION

The present invention relates to a proximity alert system capable of being worn.

BACKGROUND OF THE INVENTION

Among the greatest fears among parents, the mere thought of a child becoming lost or, worse yet, kidnapped sends shivers down one's spine. In a society that is becoming increasingly desensitized to learning of some of the unthinkable crimes against children, parents are forced to become more and more aware of the location of their children at all times. Even so, everyone is bound to lose their guard and, when this occurs, disaster can result. Similar dangerous situations can arise when a child is accidentally left behind in a hot vehicle by distracted parents or care providers.

Accordingly, there is a constant need for a means by which parents can monitor the location of their children constantly in order to prevent such an occurrence. The use of the system helps to ensure that a child is always near and the unthinkable disaster of a lost or forgotten child will not occur.

SUMMARY OF THE INVENTION

The principles of the present invention provide for a wearable proximity alert system, comprises a caregiver band wore by a caregiver. The caregiver band has a face with a first strap side extending away from a first side and a second strap side extending away from an opposing second side. The wearable proximity alert system also comprises a toddler band worn by a toddler. The caregiver band has a face with a first strap side extending away from a first side and a second strap side extending from an opposing second side. The wearable proximity alert system also comprises a plurality of switches which are located on each of the sides of each the faces of each of the bands. Each of the switches represents a selectable distance range between the caregiver band and the toddler band. The wearable proximity alert system also comprises a plurality of indicia which are located on each of the sides of each the faces of each of the bands.

The bands each may include a personal electronic device selected from the group consisting of a smartphone, a tablet, or a smart watch. A distal end of the first strap side of the bands each may have a first fastener while a distal end of the second strap side of the bands may have a second fastener. The first fastener and the second fastener of each of the bands may be securely mating with each other, thereby removably attaching the first strap side and the second strap side together to secure each of the bands to the user.

The fasteners and the strap sides of each of the bands may be length adjustable. The face of each of the bands may have a geometrical cross-sectional shape which may be selected from the group consisting of a circular cross-sectional shape, a square cross-sectional shape, or a hexagonal cross-sectional shape. The face of each of the bands may have a display surrounded by a bezel. The display may be a digital display. The toddler band may be in wireless communication with the caregiver band. The caregiver band and the toddler band may be in electronic communication via wireless communication.

The wireless communication band may be received or transmitted via an antenna in electrical communication with a transmitter and the transmitter may be connected to a microcontroller powered by a battery. The first switch, the second switch, the third switch, and the fourth switch may serve as inputs to the microcontroller while the first indicia, the second indicia, the third indicia, and the fourth indicia along with an audible alert, the tactile alert, and the visible alert may serve as outputs to the microcontroller. The caregiver band and the toddler band have a same design and are interchangeable. The switches may include a first switch located on the upper right side of each of the faces, a second switch may be located on the lower right side of each the faces, a third switch may be located on the lower left side of each of the faces, and a fourth switch may be located on the upper left side of each of the faces.

The indicia may include a first indicia located on the faces adjacent the first switch, a value of which may correspond to the first switch, a second indicia located on the faces adjacent the second switch, a value of which may correspond to the second switch, a third indicia which may be located on the faces adjacent to the third switch, a value of which may correspond to the third switch, and a fourth indicia which may be located on the faces adjacent the fourth switch and a value of which corresponds to the fourth switch.

The first indicia may have an effective range of 30 ft. for the first switch while the second indicia may have an effective range of 40 ft. for the second switch. The third indicia may have an effective range of 50 ft. for the third switch while the fourth indicia may have an effective range of 100 ft. for the fourth switch. Each of the bands may select the effective ranges and therefore have a transceiver emitting and transmitting wireless communication to the other band.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
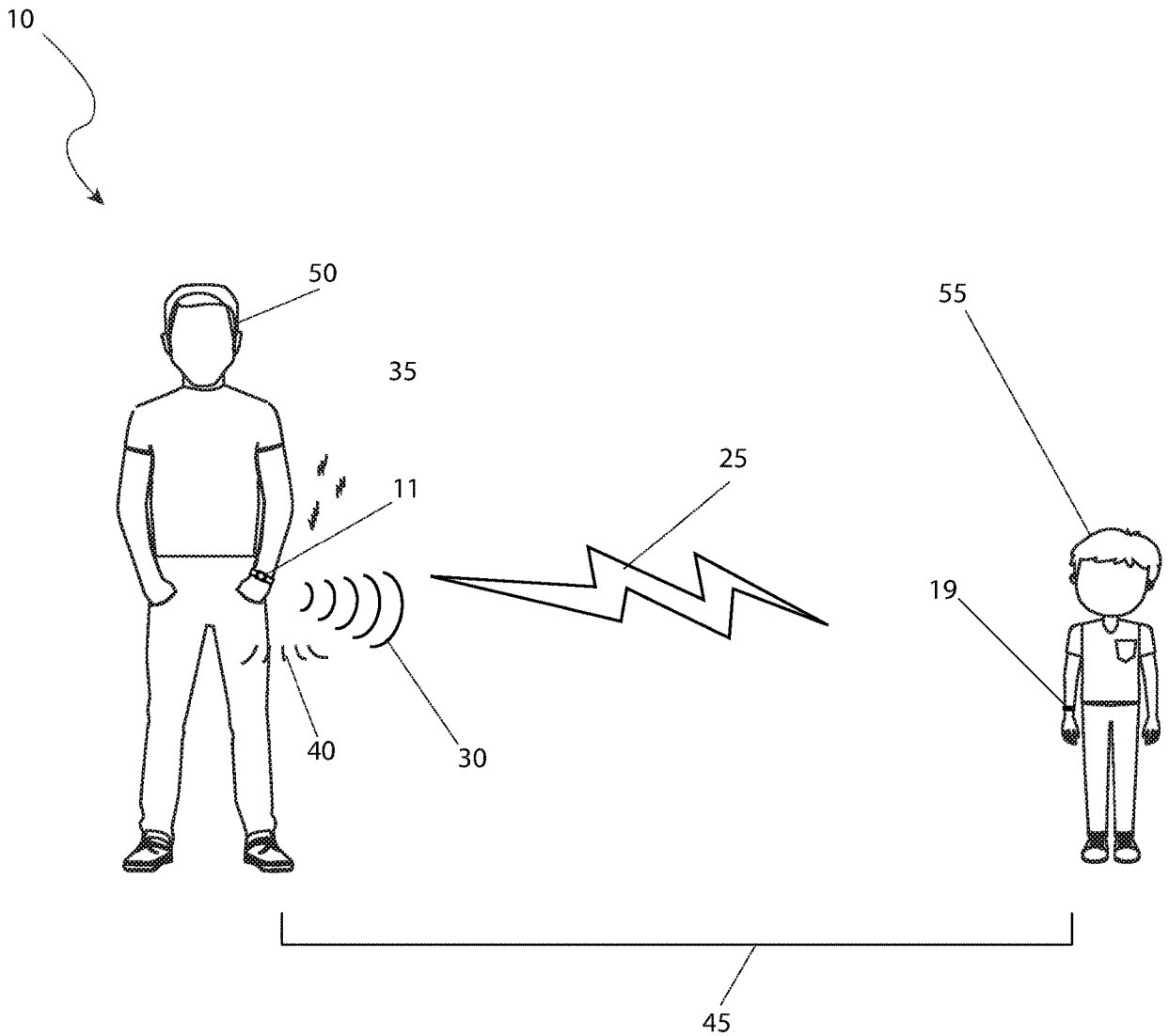
FIG. 1 is a perspective view of the wearable proximity alarm system 10, according to the preferred embodiment of the present invention.

10 wearable proximity alert system
11 caregiver band
12 face
13*a* first strap side
13*b* second strap side
14*a* first fastener

14*b* second fastener
15*a* first switch
15*b* second switch
15*c* third switch
15*d* fourth switch
17*a* first indicia
17*b* second indicia
17*c* third indicia
17*d* fourth indicia
19 toddler band
25 wireless communication
30 audible alert
35 tactile alert
40 visible alert
45 selective distance
50 caregiver
55 toddler
60 antenna
65 transmitter
70 microcontroller
75 battery

1. Description of the Preferred Embodiment

Figure 2:
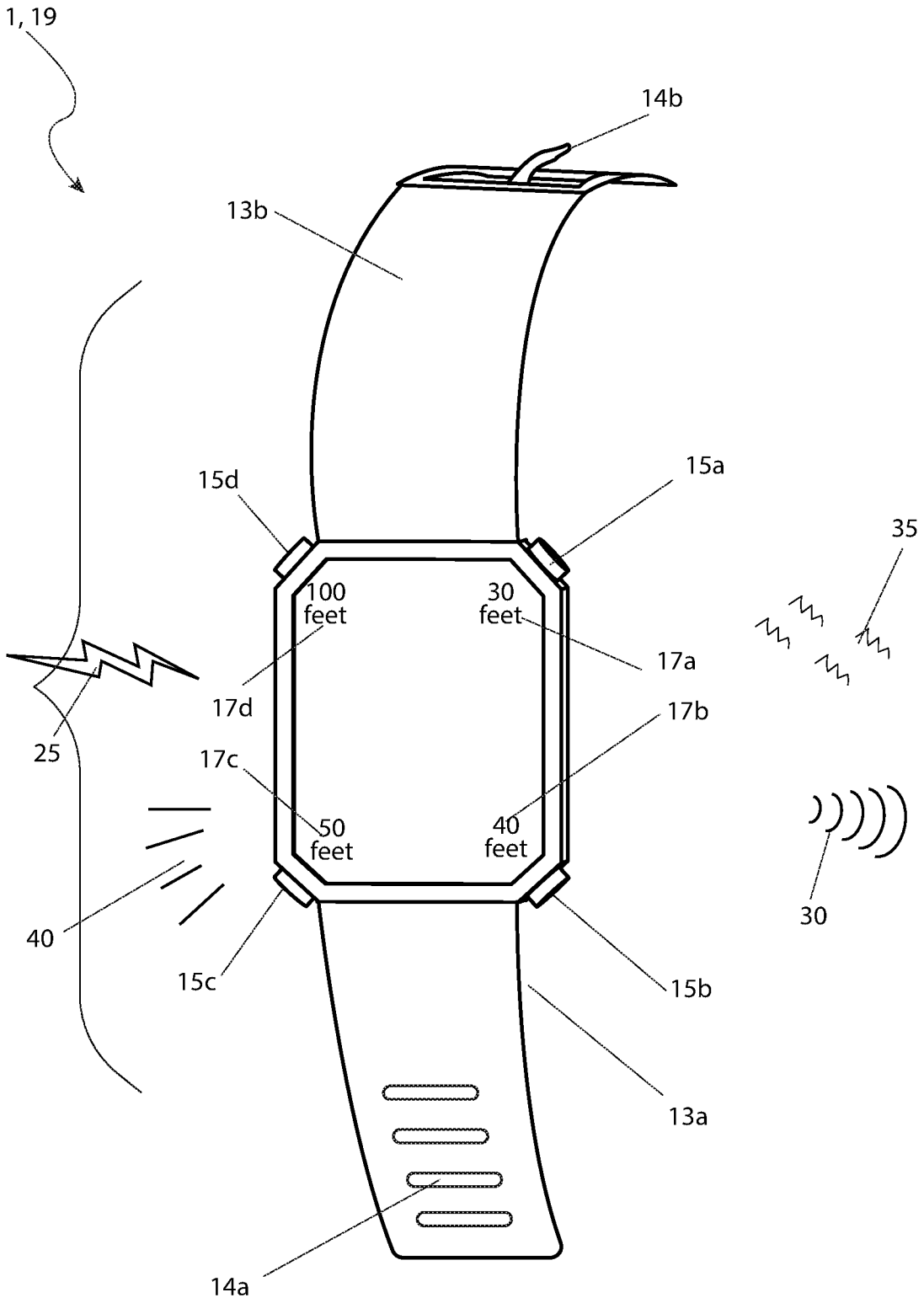
FIG. 2 is a top view of an individual representation of the caregiver band 11 and toddler band 19, according to a preferred embodiment of the present invention; and, FIG. 3 is an electrical block diagram of the major electrical components as used in the wearable proximity alarm system 10, according to the preferred embodiment of the present invention.
Figure 3:
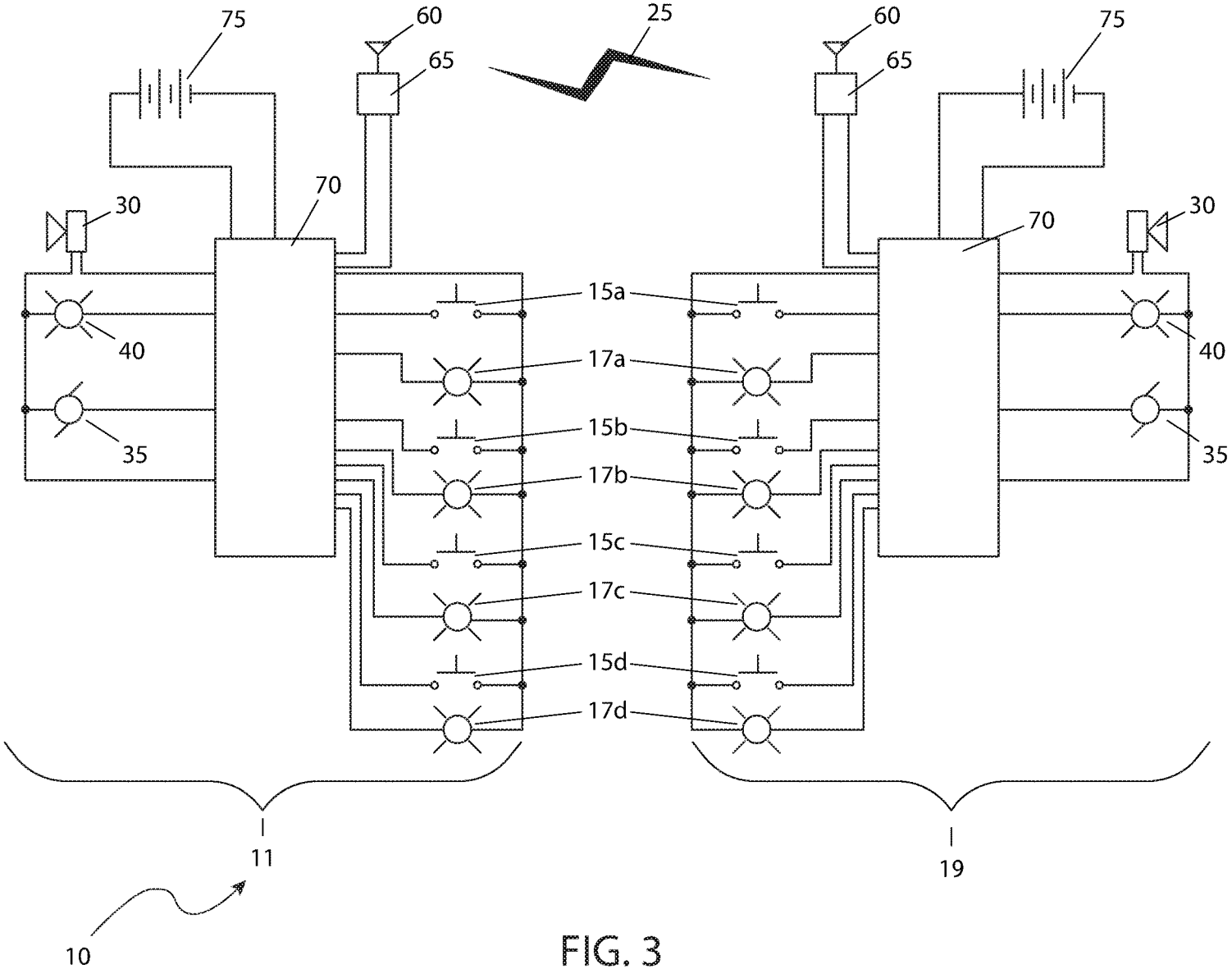

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

Referring now to FIG. 1, the present invention essentially comprises a wearable proximity alert system (herein described as the "system") 10, that provides a caregiver band 11 capable of being worn by a caregiver 50 in wireless communication 25 with a toddler band 19 capable of being worn by a toddler 55. When the toddler band 19 is detected as being out of a selected range by the caregiver band 11, the caregiver band 11 emits an alert signal 30, 35, 40.

Referring more closely now to FIG. 2, it is shown a close-up view of an exemplary embodiment of either the caregiver band 11 or the toddler band 19. It is appreciated that either band 11, 19 can be identical, similar, or different in size, shape, and design, so long as the overall scope of wireless communication 25 between the bands 11, 19 is maintained. Further, the caregiver band 11, may not be a band to be worn about the wrist at all. The wireless communication 25 can be between the toddler band 19 and a personal electronic device such as a smartphone, tablet, or similar device, wherein an executable application must be pre-loaded on such a device and running in order to function as described herein.

The band 11, 19 in an exemplary embodiment has a face 12 with a first strap side 13*a* extending away from a first side thereof, and a second strap side 13*b* extending from an opposing second side thereof. The distal end of the first strap side 13*a* has a first fastener 14*a*. Similarly, the distal end of the second strap side 13*b* has a second fastener 14*b*. It is appreciated that the first fastener 14*a* and second fastener 14*b* are capable or secure mating with each other, thereby removably attaching the first strap side 13*a* and second strap side 13*b* together to secure the band 11, 19 to a user. Such an embodiment can be a wrist-worn device to be secured to the wrist of the respective user 50, 55. Any type of fastener 14*a* 14*b* can be envisioned, such as a buckle and keeper, tab and slot, etc. The fasteners 14*a*, 14*b* and/or the strap sides 13*a*, 13*b* can be length adjustable. The face 12 can be any geometrical cross-sectional shape, such as circular, square, hexagonal, etc. and can have a digital or other display, surrounded by a bezel.

Located on the side of the face 12, or on the side of the bezel of the face 12, are a plurality of switches 15*a*, 15*b*, 15*c*, 15*d*. For purposes of illustration and description, the number of switches 15*a*, 15*b*, 15*c*, 15*d* are four (4) although any number more or less can fall under the scope of the invention, as long as there is room. In a preferred embodiment a first switch 15*a* is located approximately on the upper right side of the face 12, a second switch 15*a* is located approximately on the lower right side of the face 12, a third switch 15*a* is located approximately on the lower left side of the face 12, and a fourth switch 15*a* is located approximately on the upper left side of the face 12. Each switch 15*a*, 15*b*, 15*c*, 15*d* represents a selectable distance range between the caregiver band 11 and the toddler band 19. A first indicia 17*a* is printed or otherwise located on the face 12 adjacent the first switch 15*a*, the value of which corresponds to the first switch 15*a*. In a similar fashion, a second indicia 17*b* is printed or otherwise located on the face 12 adjacent the second switch 15*b*, the value of which corresponds to the second switch 15*b*, a third indicia 17*c* is printed or otherwise located on the face 12 adjacent the first third 15*c*, the value of which corresponds to the third switch 15*c*, and a fourth indicia 17*d* is printed or otherwise located on the face 12 adjacent the fourth switch 15*d*, the value of which corresponds to the fourth switch 15*d*. In an exemplary embodiment, the first indicia 17*a*, and therefore an effective range of the first switch 15*a* represents thirty feet (30 ft.), the second indicia 17*b*, and therefore an effective range of the second switch 15*b* represents forty feet (40 ft.), the third indicia 17*c*, and therefore an effective range of the third switch 15*c* represents fifty feet (50 ft.), and the fourth indicia 17*d*, and therefore an effective range of the fourth switch 15*d* represents one hundred feet (100 ft.).

Referring to FIG. 3, an electrical block diagram of the major electrical components as used in the system 10, according to the preferred embodiment of the present invention is shown. It is noted that the caregiver band 11 and the toddler band 19 are of the same electrical design and are interchangeable. For the purposes of description, the caregiver band 11 is shown on the left-hand side and the toddler band 19 is shown on the right. The electrical description hereinbelow applies to both the caregiver band 11 and the toddler band 19. The caregiver band 11 and the toddler band 19 are in electronic communication via wireless communication 25 such as an RF signal. The wireless communication 25 is received or transmitted via an antenna 60 in electrical communication with a transmitter 65. In turn, the transmitter 65 is connected to a microcontroller 70 powered by a battery 75. The first switch 15*a*, the second switch 15*b*, the third switch 15*c*, and the fourth switch 15*d* serve as inputs to the microcontroller 70, while the first indicia 17*a*, second indicia 17*b*, third indicia 17*c*, and the fourth indicia 17*d* along with the audible alert 30, the tactile alert 35, and the visible alert 40 serve as outputs.

In a preferred method of use, either band 11, 19 is capable of selecting the effective range, and therefor has minimally a transceiver capable of emitting and transmitting wireless communication 25 to the other band, a power source (not shown), an audible alert 30, a tactile alert 35, and a visible alert 40 for alerting either the caregiver 50 or the toddler 55 of travel outside the selected range. In an exemplary method of use, the caregiver 50 wears the caregiver band 11 and the toddler wears the toddler band 19. The caregiver 50 selects a range one hundred feet (100 ft.) by activating the fourth switch 15*d*. This sets the range of one hundred feet (100 ft.) that the toddler band 19 and caregiver band 11 must be in proximity to each other, as verified by continuous wireless communication 25 therebetween. Once this range is exceeded, either or both band 11, 19 can activate any or all of the audible alert 30, tactile alert 35, and visible alert 40.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A wearable proximity alert system, comprising:

a caregiver band adapted to be wore by a caregiver, the caregiver band having a face with a first strap side extending away from a first side thereof and a second strap side extending from an opposing second side thereof;

a toddler band adapted to be wore by a toddler, the toddler band having a face with a first strap side extending away from a first side thereof and a second strap side extending from an opposing second side thereof;

a plurality of switches located on each of the sides of each the faces of each of the bands, each of the switches represent a selectable distance range between the caregiver band and the toddler band;

a plurality of indicia located on each of the sides of each the faces of each of the bands;

wherein a distal end of the first strap side of the bands each have a first fastener and a distal end of the second strap side of the bands has a second fastener;

wherein the caregiver band and the toddler band have a same design and are interchangeable;

wherein the switches include a first switch located on the upper right side of each of the faces, a second switch is located on the lower right side of each the faces, a third switch located on the lower left side of each of the faces, and a fourth switch located on the upper left side of each of the faces;

wherein the indicias includes a first indicia located on the faces adjacent the first switch, a value of which corresponds to the first switch, a second indicia located on the faces adjacent the second switch, a value of which corresponds to the second switch, a third indicia located on the faces adjacent to the third switch, a value of which corresponds to the third switch, and a fourth indicia located on the faces adjacent the fourth switch, a value of which corresponds to the fourth switch; and wherein each of the bands select the effective ranges and therefore have a transceiver emitting and transmitting wireless communication to the other band.

2. The wearable proximity alert system according to claim 1, wherein the bands each include a personal electronic device selected from the group consisting of a smartphone, a tablet, or a smart watch.

3. The wearable proximity alert system according to claim 1, wherein the first fastener and the second fastener of each of the bands are securely mating with each other, thereby removably attaching the first strap side and the second strap side together to secure each of the bands to a user.

4. The wearable proximity alert system according to claim 3, wherein the fasteners and the strap sides of each of the bands are length adjustable.

5. The wearable proximity alert system according to claim 1, wherein the face of each of the bands have a geometrical cross-sectional shape selected from the group consisting of a circular cross-sectional shape, a square cross-sectional shape, or a hexagonal cross-sectional shape.

6. The wearable proximity alert system according to claim 1, wherein the face of each of the bands have a display surrounded by a bezel.

7. The wearable proximity alert system according to claim 6, wherein the display is a digital display.

8. The wearable proximity alert system according to claim 1, wherein the toddler band is in wireless communication with the caregiver band.

9. The wearable proximity alert system according to claim 8, wherein the caregiver band and the toddler band are in electronic communication via wireless communication.

10. The wearable proximity alert system according to claim 9, wherein the wireless communication is received or transmitted via an antenna in electrical communication with a transmitter and the transmitter is connected to a microcontroller powered by a battery.

11. The wearable proximity alert system according to claim 10, wherein the first switch, the second switch, the third switch, and the fourth switch serve as inputs to the microcontroller and the first indicia, the second indicia, the third indicia, and the fourth indicia along with an audible alert, the tactile alert, and the visible alert serve as outputs to the microcontroller.

* * * * *